US007362221B2

(12) United States Patent
Katz

(10) Patent No.: US 7,362,221 B2
(45) Date of Patent: Apr. 22, 2008

(54) TOUCHSCREEN DEVICE FOR CONTROLLING A SECURITY SYSTEM

(75) Inventor: Fred Katz, Hauppauge, NY (US)

(73) Assignee: Honeywell International Inc., Morristown, NJ (US)

( * ) Notice: Subject to any disclaimer, the term of this patent is extended or adjusted under 35 U.S.C. 154(b) by 205 days.

(21) Appl. No.: 11/270,082

(22) Filed: Nov. 9, 2005

(65) Prior Publication Data

US 2007/0103433 A1 May 10, 2007

(51) Int. Cl.
*G08B 1/08* (2006.01)

(52) U.S. Cl. ..... 340/539.11; 340/539.24; 340/425.5; 340/426.13; 340/426.19; 340/426.28; 340/500; 701/35; 701/213; 346/156; 346/173

(58) Field of Classification Search ..... 340/539.11, 340/539.24, 425.5, 426.13, 426.28, 426.19, 340/500; 701/35, 213; 346/156, 173
See application file for complete search history.

(56) References Cited

U.S. PATENT DOCUMENTS 6,127,941 A * 10/2000 Van Ryzin ..... 340/825.69
7,248,150 B2 * 7/2007 Mackjust et al. ..... 340/426.13
2005/0162402 A1 * 7/2005 Watanachote ..... 345/173
2007/0093786 A1 * 4/2007 Goldsmith et al. ..... 604/890.1

FOREIGN PATENT DOCUMENTS

WO WO 2005/039144 A1 4/2005

* cited by examiner

*Primary Examiner*—Tai Nguyen
(74) *Attorney, Agent, or Firm*—Anthony R. Barkume, P.C.

(57) ABSTRACT

The present invention is a hand held portable remote such as a key fob that allows a user to interact with the security system using a flat panel touch-pad. The touch-pad input allows a user to rapidly select and control a large number of security functions, such as Arm, Disarm, Panic, garage door open, lamp on/off, and lamp dimming control, etc. The security device comprises a housing, a wireless communication port for interface with the security system, a touch-pad input device, and processing circuitry. In order to operate the security device, the user generates a user input by creating a contact motion on the touch-pad input device with a fingertip. The contact motion may consist of a swiping motion, a tapping, or a circular motion. In order to distinguish the contact motion clearly, when the fingertip contact comprises a wider than normal contact, it causes the processing circuitry to not generate an output signal. The security device also comprises an LCD display for displaying alpha numeric control options to a user and LED indicators for indicating the modes of the processing circuitry.

17 Claims, 3 Drawing Sheets

TOUCHSCREEN DEVICE FOR CONTROLLING A SECURITY SYSTEM

TECHNICAL FIELD

This invention relates to security systems, and in particular to a control device with a touch-screen or touch-pad that is used to control a security system.

BACKGROUND ART

Nearly all security systems of today utilize sophisticated control devices to perform the functions of programming the security system, arming or disarming the security system, providing a panic alert, controlling lighting, and controlling garage doors, etc. Many security systems employ multiple control devices to allow a user more flexibility in controlling the security system. The control devices may be wired or wireless wall-mounted control panels located at different entrances to the protected area or wireless portable handheld devices that can control the security system from outside the protected area.

A convenient embodiment of a wireless handheld device is a key fob that is small enough to be placed on a key chain. Key fobs are customarily used for locking and unlocking automobiles. They have room for only a few buttons to allow convenient placement of the device on a key chain which can be held in a pants pocket. The small number of buttons is a problem for security system control devices because it limits the amount of controllable functions the device can perform. It is therefore desirable for a homeowner to have a control device that performs the multiple function of a wall mounted control panel while having the size and convenience of a key fob.

An additional concern of a wireless handheld device is that the buttons on the device are subject to inadvertent activation when something rubs against the device. When a key fob is placed in a pants pocket, the buttons may be depressed when the person bends or sits down or the buttons come in contact with keys or coins. This may cause the security system to be put in an undesirable mode. For proper operation of the security system, the key fob must be designed to safeguard against this problem.

It is therefore an object of the present invention to provide a small portable handheld control device that can control the many functions of a security system.

It is a further object of the present invention to provide a method for quickly selecting and controlling the many functions of a security system.

It is a further object of the present invention to provide a control device that is not inadvertently activated by contact with keys, clothing, coins, etc.

Finally, it is a further object of the present invention to provide a display to the user to inform the user of the security devices transmissions and operations.

DISCLOSURE OF THE INVENTION

The present invention is a touch-screen security device that is able to remotely control functions of a security system. The security device is generally a hand held portable remote device such as a key fob that allows a user to interact with the security system using a flat panel touch-pad input instead of push buttons. The touch-pad input allows a user to rapidly select and control many security and house-control functions, such as Arm, Disarm, Panic, garage door open, lamp on/off, and lamp dimming control, etc. The security system procedures for performing these and other functions are well known to one skilled in the art and will not be described.

The security device comprises a housing, a wireless communication port for interfacing with the security system, a touch-pad input device, and processing circuitry. The touch-pad input device allows a user to provide user inputs, as described below, and provides a control signal to the processing circuitry that is related to the selected user input. The processing circuitry accepts the control signal and generates output signals based on it. The processing circuitry generates output signals that control the security device, as described below, and output signals that are transmitted to the security system via an antenna.

In order to operate the security device, the user generates a user input by creating a contact motion on the touch-pad input device with a fingertip. The contact motion may be for example a tapping motion, a clockwise circular motion, a counterclockwise circular motion, a swiping motion from top to bottom, a swiping motion from bottom to top, a swiping motion from left to right, or a swiping motion from right to left of the touch pad. In order to distinguish the contact motion clearly, when the fingertip contact comprises a wider than normal contact, it causes the processing circuitry to not generate an output signal.

The security device also comprises a display such as an LCD display for displaying alpha numeric control options to be selected by a user and LED indicators for indicating the modes of the processing circuitry. In an alternative embodiment the LCD display may contain graphics that indicate the modes of the processing circuitry. The user views the control options displayed on the LCD and uses the contact motions on the touch-pad as described above to either (1) select the current control option displayed, (2) scroll to a different control option, or (3) go into a programming mode. In order to perform these operations, the security device processing circuitry uses a micro-computer to input the control signals from the touch-pad device and, depending on the control signal, the micro-computer outputs signals to the LCD display, the LED indicators, and/or the RF transmitter. In order to provide flexibility to the user, the control options are programmed into the security device by an installer (or the user) when the security device is put into the programming mode.

The present invention is also a method of accepting a user input into the security device described above and controlling a security system comprising the steps of inputting a user input into a touch-pad, converting the user input into a control signal related to the user input, and transmitting an output signal to the security system as a function of the control signal. The user input is the same contact motions described above. The present invention also comprises the steps of displaying a control option to be selected by the user and programming the control option into the security device by the user.

The method of operation of the present invention is as follows. The user views the control option on the security device display and performs a contact motion on the touch-pad. The touch-pad provides a control signal to the processing circuitry that corresponds to the contact motion, and the processing circuitry determines the processing state based on the control signal. If the processing state is a first level processing state, then the processing circuitry transmits to the security system an output signal which is a function of the control signal. An example of a first level processing state would be an execute input which may be a left to right finger swipe contact motion. This indicates acceptance of the currently displayed control option. A first level processing state requires no further input from the user. If the processing state is a second level processing state, then the processing circuitry revises the control option displayed to the user, accepts a subsequent user input into the touch-pad, and converts the subsequent user input into a control signal related to the subsequent user input. These steps may be repeated. An example of a second level processing state would be a mode select input which may be a right to left finger swipe contact motion. A second level processing state requires an additional input from the user. The present invention also comprises the step of indicating the mode of the processing circuitry by illuminating LEDs, which helps the user to know if the security device is executing a command or waiting for an input. In an alternative embodiment, the step of indicating the mode of the processing circuitry is performed by the LCD display which contains graphics that indicate the modes of the processing circuitry.

BEST MODE FOR CARRYING OUT THE INVENTION

Figure 1:
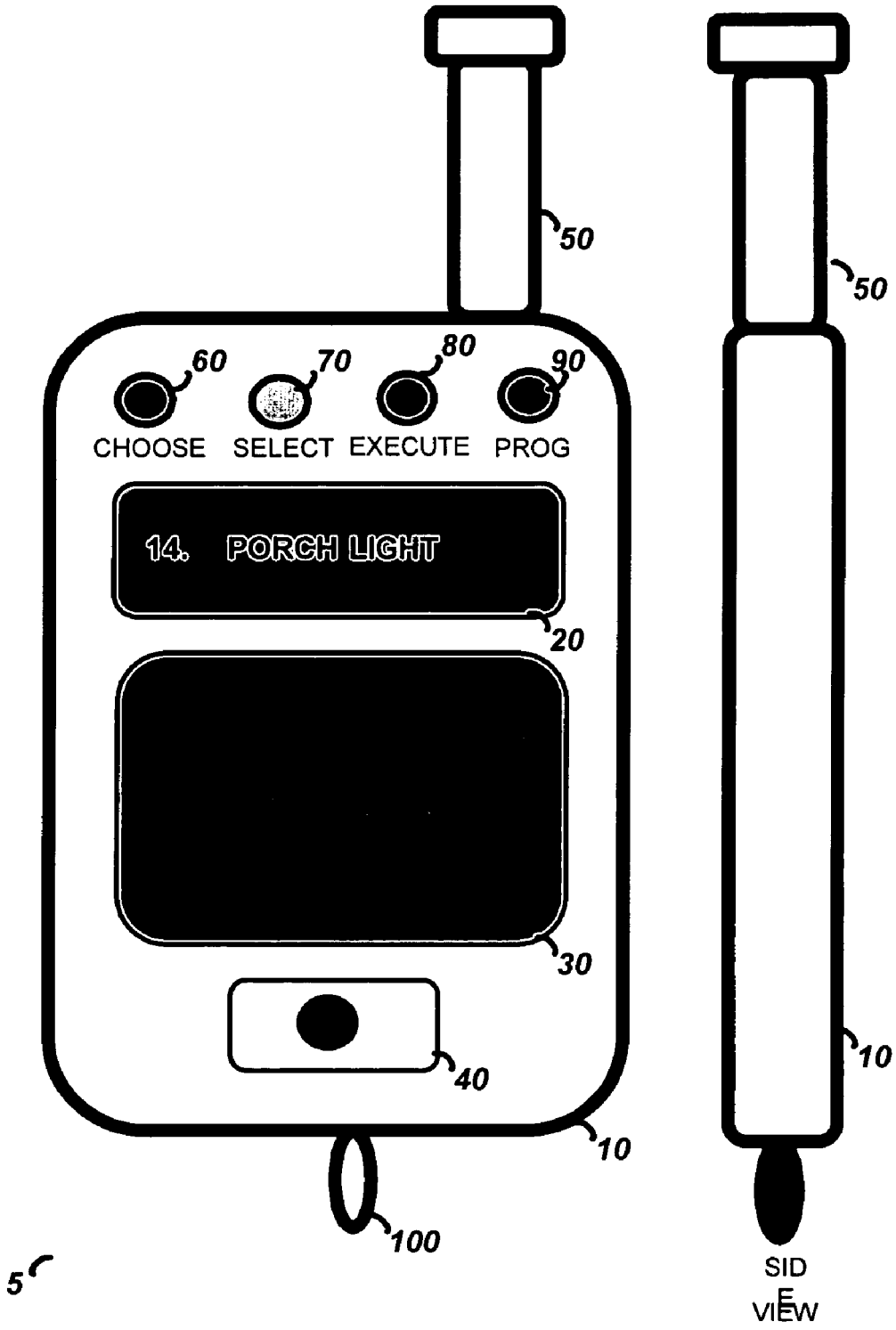
FIG. 1 is a diagram of the security device of the present invention.

The preferred embodiments of the present invention will now be described with respect to the Figures. FIG. 1 illustrates the security device 5 as a key fob. Shown are front and side views of the key fob housing 10. The key fob housing 10 has an antenna 50 and a keychain loop 100 attached to it. The antenna 50 provides a large transmission range, while the keychain loop 100 allows the security device 5 to be easily attached to a keychain. The antenna 50 may be extendable, fully retractable, or built-in (totally internal). The key fob housing 10 contains a recessed power on button 40, an LCD display 20, a touch pad 30, and four LEDs 60, 70, 80, and 90. The power button is pushed to turn the security device 5 on. If it is turned on accidentally, it will turn itself off after a short time of inactivity because it will interpret inactivity as no valid user input on the touch pad 30. Once the security device 5 is turned on, the LCD display 20 will be lit by the backlight LED 110 and a control option will be displayed. The LCD display 20 presently shows the control option "14. PORCH LIGHT". A predefined number of control options will be available in a list form, and the user will either select the currently displayed control option or scroll through the list until a desired control option is displayed (only one control option is displayed for selection at a given time). In the example given, the number "14" is the object number of the control option. Once the user reads the current control option, he uses the touch-pad 30 to select that control option or to scroll to a different control option. The touch-pad senses a tapping or swiping motion from the users finger tip. If the contact is larger than a finger tip then the security device 5 ignores the input. For example, if the touch-pad 30 is pressed against the user's leg the security device 5 will ignore the input. This is to safeguard against inadvertent selections. The LEDs 60, 70, 80, and 90 provide feedback to the user as to what action the security device 5 is performing. The SELECT LED 70 is lit when the user needs to select a control option. The EXECUTE LED 80 is lit when a command has been executed. The CHOOSE LED 60 is lit when the security device's 5 mode is being selected, and the PROG LED 90 is lit when the security device 5 is in a program mode.

Figure 2:
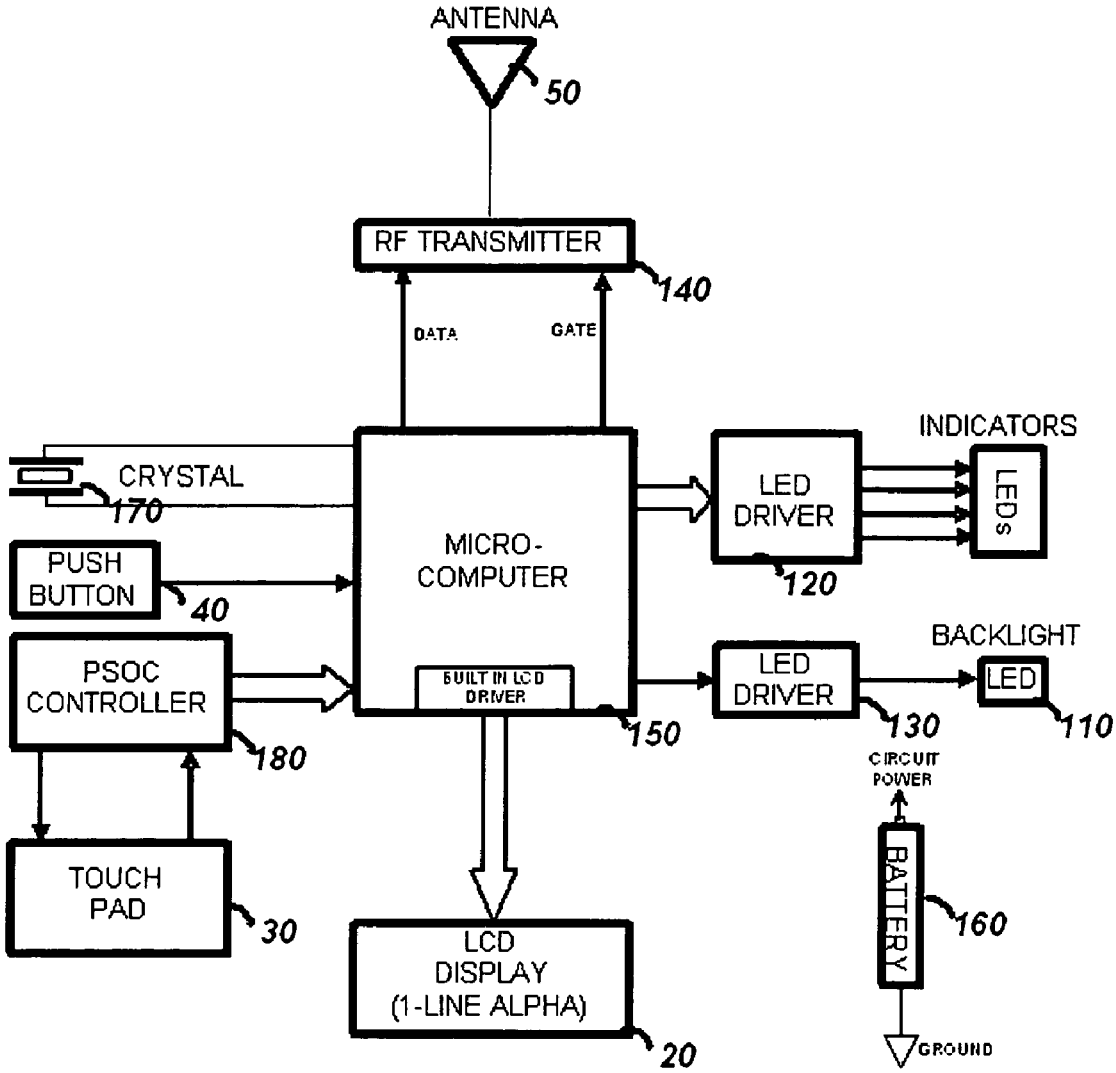
FIG. 2 is a circuit diagram of the present invention.

FIG. 2 shows a circuit diagram of the security device 5. The security device's 5 processor is a single chip microcomputer 150 with a clock input from crystal 170. The microcomputer 150 is normally in a sleep mode or hibernation state, drawing very little battery power from the battery 160. When the power on button 40 is pushed, the microcomputer 150 wakes up and places a message on the LCD display 20. The microcomputer 150 contains a built in LCD driver that directly controls the LCD display 20. The microcomputer 150 also sends output signals to the LED driver 120 that cause the LEDs 60, 70, 80, and 90 to be illuminated when the microcomputer 150 is performing the functions described above. An additional LED driver 130 controls the backlight LED 110 that lights the LCD display 20 when a control option is displayed to allow the user to see it. The microcomputer 150 communicates with the security system via RF transmitter 140. The RF transmitter 140 accepts message data from the microcomputer 150 and when commanded by the microcomputer 150 converts the data to an RF message and transmits it to the security system through antenna 50. The message structure and the transmit protocols are compatible with home security control panels as known in the art. The signals transmitted may also be compatible with receiver devices that are interface with X-10 type Line Voltage control modules or equivalent AC power control devices or wireless control units, all as well known in the art.

The touch-pad 30 is a key feature in the design of the security device 5. It provides quick access to all of the security system functions, thus allowing the key fob 10 to operate like a sophisticated control device. In the preferred embodiment, The touch-pad 30 and its PSoC (programmable systems-on-chips) controller 180 are manufactured by Cypress Semiconductor Corporation. The PSoC controller 180 is programmed to read and process inputs from the touch-pad 30 by Cypress and generally works as follows. The touch-pad 30 has an underlying grid work of conductors and the PSoC controller 180 capacitively senses the presence of a finger on the touch pad 30 by generating a series of pulses on one part of the touch-pad 30 gridwork and measures the return signal to another part of the gridwork. It isolates the physical location of where the user's fingertip touched the touch-pad 30 by determining the location of the capacitance change. The location information is then processed by the PSoC controller 180 to provide output signals to the micro-computer 150 that are correlated to the location of the fingertip touch. The PSoC controller 180 also provides signals that are correlated to the direction of the movement of the fingertip touch. The microcomputer 150 decodes the signals from the PSoC controller 180 to determine which finger stroke, or user input, was performed. Thus, the microcomputer can determine, based on inputs from the PSoC controller, if the user performed a single tap, a left to right stroke, a circular stroke, etc.

Figure 3:
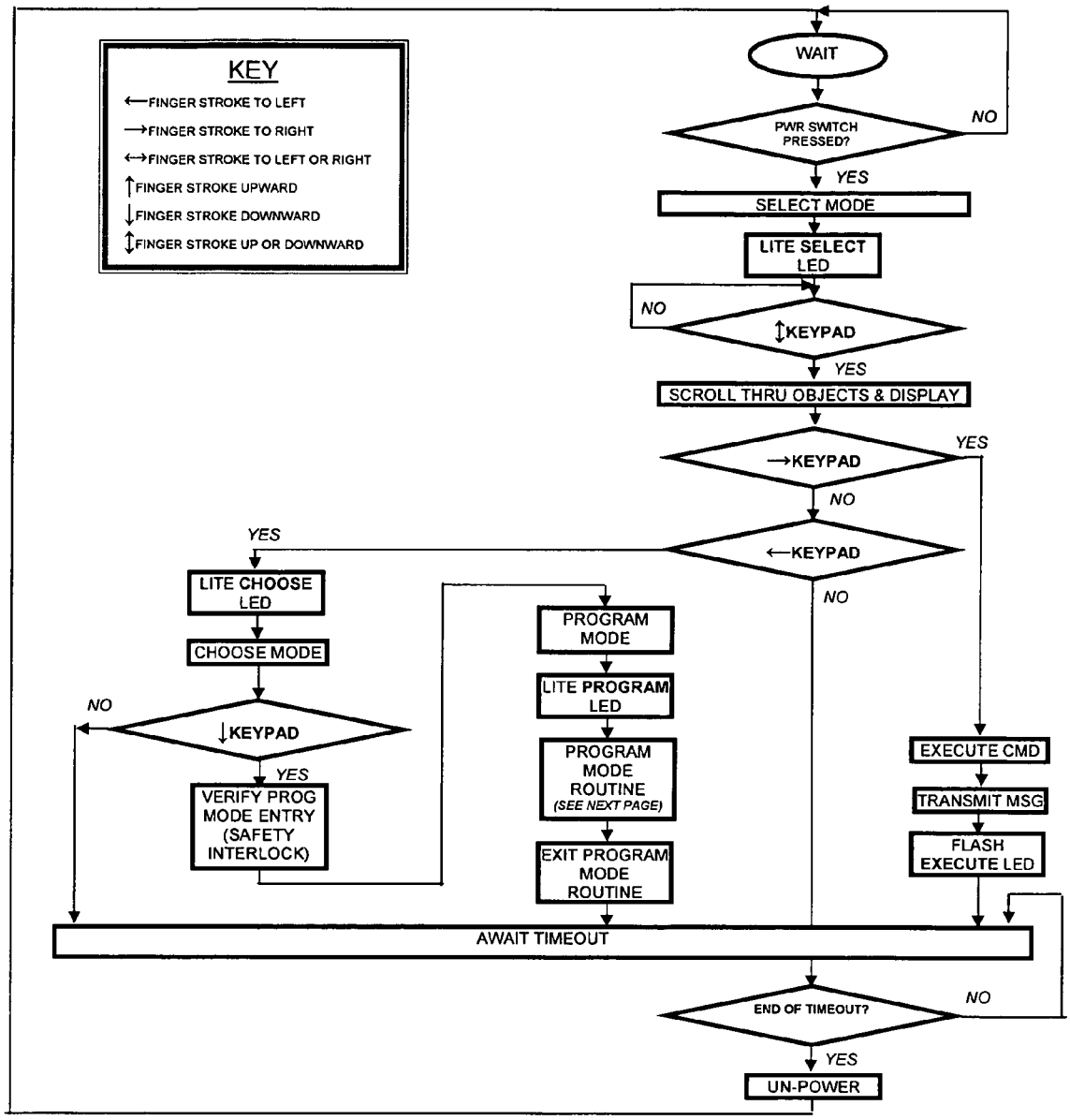
FIG. 3 is a mode of operation flowchart of the present invention.

FIG. 3 shows a top level flow diagram of the microcomputer 150 operation. When the power button 40 is depressed the Select LED 70 is lit and a control option is displayed on the LCD. The microcomputer 150 waits for a user input to the touch-pad 30. If no input is received after an amount of time, the microcomputer 150 goes into a sleep mode until the power button 40 is depressed again. If the touch-pad 30 input is a down finger stroke, the microcomputer 150 displays the next control option on the LCD 20 and waits for another touch-pad 30 input. If the touch-pad 30 input is an up finger stroke, then the previous control option is displayed on the LCD 20. The list of control options may have any number of entries, and the list scrolls and then wraps around from the last to the first and/or from the first to the last. If the touch-pad 30 input is a left to right finger stroke, this indicates acceptance of the current control option and the microcomputer 150 executes the control option that is displayed on the LCD 20. The microcomputer 150 performs this command by composing a message consisting of the object number of the control option, the serial number of the keypad of the security system and other housekeeping data. The microcomputer 150 then sends the message to the RF transmitter 140 and commands the transmitter 140 to transmit the message to the security system. Finally the Execute LED 80 is flashed on and the microprocessor 150 waits a timeout period and then goes to sleep.

If the touch-pad 30 input is a right to left finger stroke, then the microcomputer 150 lights the Choose LED 60 and goes into the choose mode. If the next touch-pad 30 input is a down finger stroke then the microcomputer 150 goes into the program mode. This two step process is used to prevent the user from inadvertently programming spurious data into the security device 5. The Program LED 90 is lit and the microcomputer 150 performs the program routine. The programming mode may be used for initial installation of the security device 5 or reprogramming of the security device 5. When the security device 5 is initially manufactured it does not have the various control options programmed into it. The user (or installer) enters the programming mode to program each object number (0-31) with a control option (arm, disarm, lamp on/off, etc.) that describe each security system function. During this procedure, the user is prompted with messages on the LCD 20 to guide the user to select the object number, the type of object, and the alphanumeric descriptor that describes the object (the control option). Also during the installation process, the security system's alarm panel is programmed to accept data from the security device 5 by recognizing a unique serial number associated with the security device 5 (programmed during manufacture) that is sent as part of the transmitted message. The object numbers programmed to be associated with a particular object by the user or installer in the security device 5 must also be programmed into the security system's alarm panel to correspond to the appropriate security system function.

It will be apparent to those skilled in the art that modifications to the specific embodiment described herein may be made while still being within the spirit and scope of the present invention. For example, programming of the security device 5 may also be accomplished by coupling the security device 5 to a laptop computer to have all of the control data and nomenclature downloaded from a computer program directly to the security device 5. Lastly, an alternative embodiment of fitting the security device 5 with a "Bluetooth" interface (a wireless interface protocol) to allow long distance control of a security system using a cell phone may be implemented. In this application, the Bluetooth interface is a communication channel used by the security device 5 to request a cell phone carried by the user to transmit a message to the home security system as well known in the art.

What is claimed is:

1. A security device for use with a security system comprising:

a. a housing, b. a wireless communication port for interface with said security system, c. a touch-pad input device for inputting a user input from a user and providing a control signal related to said user input, d. processing circuitry for displaying a control option to said user, and determining a processing state based on said control signal, wherein i. if the processing state is a first level processing state then transmitting an output signal to said security system as a function of said control signal, or ii. if the processing state is a second level processing state then:

(i) updating the control option displayed to said user, (ii) accepting a subsequent user input into the touch-pad, and (iii) converting said subsequent user input into a control signal related to said subsequent user input, and (iv) repeating the step of determining a processing state based on said control signal.

2. The security device of claim 1 wherein the housing is portable.

3. The security device of claim 1 further comprising an LCD display for displaying control options to a user.

4. The security device of claim 3 wherein the control options are programmed by the user.

5. The security device of claim 1 wherein said user input is generated by a contact motion on said touch pad.

6. The security device of claim 5 wherein said contact motion is generated by fingertip contact.

7. The security device of claim 5 wherein said contact motion is a tapping motion on said touch pad.

8. The security device of claim 5 wherein said contact motion is a clockwise circular motion on said touch pad.

9. The security device of claim 5 wherein said contact motion is a counterclockwise circular motion on said touch pad.

10. The security device of claim 5 wherein said contact motion is a swiping motion from top to bottom of said touch pad.

11. The security device of claim 5 wherein said contact motion is a swiping motion from bottom to top of said touch pad.

12. The security device of claim 5 wherein said contact motion is a swiping motion from left to right of said touch pad.

13. The security device of claim 5 wherein said contact motion is a swiping motion from right to left of said touch pad.

14. The security device of claim 1 further comprising LED indicators for indicating the modes of the processing circuitry.

15. A method of accepting a user input into a security device and controlling a security system, wherein said security device comprises a wireless communication port, a touch-pad input device and processing circuitry, comprising the steps of:

a. inputting a user input into said touch-pad, b. converting said user input into a control signal related to said user input, c. displaying a control option to said user, d. determining a processing state based on said control signal, i. if the processing state is a first level processing state then transmitting an output signal to said security system as a function of said control signal, or ii. if the processing state is a second level processing state then:

(i) updating the control option displayed to said user, (ii) accepting a subsequent user input into the touch-pad, and (iii)converting said subsequent user input into a control signal related to said subsequent user input, and (iv) repeating the step of determining a processing state based on said control signal.

16. The method of claim 15 further comprising the step of programming the control options into the security device.

17. The method of claim 15 further comprising the step of indicating the mode of the processing circuitry by illuminating an LED.

* * * * *